US006878017B2

(12) United States Patent
Sakurai et al.

(10) Patent No.: US 6,878,017 B2
(45) Date of Patent: Apr. 12, 2005

(54) JOINT CONNECTOR AND METHOD OF ASSEMBLING IT

(75) Inventors: Toshikazu Sakurai, Yokkaichi (JP); Masayasu Fujii, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/722,667

(22) Filed: Nov. 26, 2003

(65) Prior Publication Data

US 2004/0132349 A1 Jul. 8, 2004

(30) Foreign Application Priority Data

Nov. 28, 2002 (JP) ..... 2002-345082

(51) Int. Cl.[7] ..... H01R 11/09
(52) U.S. Cl. ..... 439/723; 439/724
(58) Field of Search ..... 439/76.2, 212, 439/92, 215, 99, 607, 608, 609, 723, 724, 722, 654, 107

(56) References Cited

U.S. PATENT DOCUMENTS 3,998,517 A * 12/1976 Griffin ..... 439/107
4,006,872 A 2/1977 Tanner
4,313,646 A * 2/1982 Millhimes et al. ..... 439/654
4,579,405 A 4/1986 Hirooka
4,643,509 A 2/1987 Hollyday et al.
5,073,120 A * 12/1991 Lincoln et al. ..... 439/92
5,102,354 A 4/1992 Crane et al.
5,433,628 A 7/1995 Sadaishi et al.
5,645,455 A 7/1997 Seki
5,908,322 A * 6/1999 Seki ..... 439/212
2002/0009909 A1 1/2002 Kondoh

FOREIGN PATENT DOCUMENTS

JP 7-8976 2/1995

* cited by examiner

*Primary Examiner*—Alexander Gilman
(74) *Attorney, Agent, or Firm*—Gerald E. Hespos; Anthony J. Casella

(57) ABSTRACT

A joint connector (JC) has a housing (30). Fitting recesses (33, 38A, 38B, 38C) are formed in opposite sides of the housing (30) for receiving a power-supply side connector (10) and electric-part side connectors (20). A ground terminal (50) has a row of tabs (55A) projecting from an edge of a busbar (51) and has a grounding plate (52) at an end of the busbar (51). The ground terminal (50) is mounted at a lower level of an intermediate wall (40) of the housing (30) by insert molding, so that the tabs (55A) are in the electric-part side fitting recesses (38A, 38B, 38C). Joint terminals (60A to 60D) have tabs (55B) projecting from opposite lateral edges of a busbar (51) and are mounted at upper and middle levels of the intermediate wall (40) by pressing so that the tabs (55B) are in the fitting recesses (33, 38A, 38B, 38C).

14 Claims, 8 Drawing Sheets

JOINT CONNECTOR AND METHOD OF ASSEMBLING IT

BACKGROUND OF THE INVENTION

1. Field of the Invention

The invention relates to a joint connector and to a method of assembling it.

2. Description of the Related Art

A ground joint connector has a housing with a connecting portion and a grounding portion. The ground joint connector also has a ground terminal with a plurality of terminal pieces projecting therefrom. The ground terminal is mounted in the grounding portion of the housing and so that the respective terminal pieces project into the connecting portion. A mating connector connected with ends of wires for grounding is fit into the connecting portion and the wires for grounding are grounded collectively (for example, see U.S. Pat. No. 5,433,628)

An intermediate connector has a housing with connecting portions at opposite ends. The intermediate connector also has a joint terminal with a main body and terminal pieces projecting from the opposite edges of the main body. The joint terminal is mounted in the housing so that the terminal pieces project into the respective connecting portions. Mating connectors are fit into the connecting portions so that wires are connected in a branched manner (see U.S. Pat. No. 5,645,455).

The above-described ground joint connector and intermediate connector use the ground terminal and the joint terminal to conduct branched connections of wires at many points at once and have simple constructions. However, the ground joint connector and the intermediate connector are provided separately. Thus, the mating connectors are connected separately therewith and a suitable installation space including a space for the connecting operation is necessary. Therefore, there has been an earnest desire to improve operability and to make a joint connector more space efficient.

The present invention was developed in view of the above situation and an object thereof is to improve operability.

SUMMARY OF THE INVENTION

The invention relates to a joint connector with a housing that has at least one pair of connecting portions into which mating connectors can be fit. At least one joint terminal is mounted in the housing and has a plurality of terminal pieces located in both connecting portions. At least one ground terminal is mounted in the housing and is connected with a grounding portion. The ground terminal has a plurality of terminal pieces located in at least one of the connecting portions.

One connector functions both as a ground joint connector and an intermediate connector. Thus, operability is improved by reducing the number of connecting operations with mating connectors. Further, installation space is reduced, including space for the connecting operations, realizing a space-saving joint connector.

The joint terminal preferably is formed so that the terminal pieces project from two different lateral edges of a busbar. The ground terminal preferably is formed so that the terminal pieces project from at least one lateral edge of a busbar and so that the grounding portion is at an end of the busbar. The joint terminal and the ground terminal may be mounted at different levels.

The joint terminal and the ground terminal are formed using a busbar as a base, and therefore are thin. Accordingly, the housing that uses these terminals at different levels is compact.

The joint terminal and/or the ground terminal preferably are press fit into the housing.

A joint pattern of the intermediate connector may change when a vehicle type differs. In such a case, different kinds of joint terminals having different arrangements of the terminal pieces need to be prepared. If the joint terminal is mounted in the housing by insert molding, a molding die needs to be changed when the joint terminal is changed. However, the joint terminal of the invention is mounted by pressing. Thus, the joint terminal can be mounted into the housing without taking any special measure, even if the shape of the joint terminal is changed. Therefore, a change in the joint pattern can be dealt with relatively inexpensively, thereby improving flexibility.

The housing preferably has at least one insertion groove into which at least part of the joint terminal and/or at least part of the grounding terminal are closely insertable. At least one press-in hole preferably is provided in the housing for pressing in corresponding terminal pieces of the joint terminal and/or the grounding terminal.

The invention also relates to a method of assembling a joint connector comprising providing a housing with at least one pair of connecting portions into which mating connectors are fittable. The method then comprises mounting at least one joint terminal having a plurality of terminal pieces in the housing so as to be located in both connecting portions. The method further comprises mounting at least one ground terminal in the housing so that terminal pieces of the ground terminal are in at least one of the connecting portions. The ground terminal is connected with a grounding portion.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
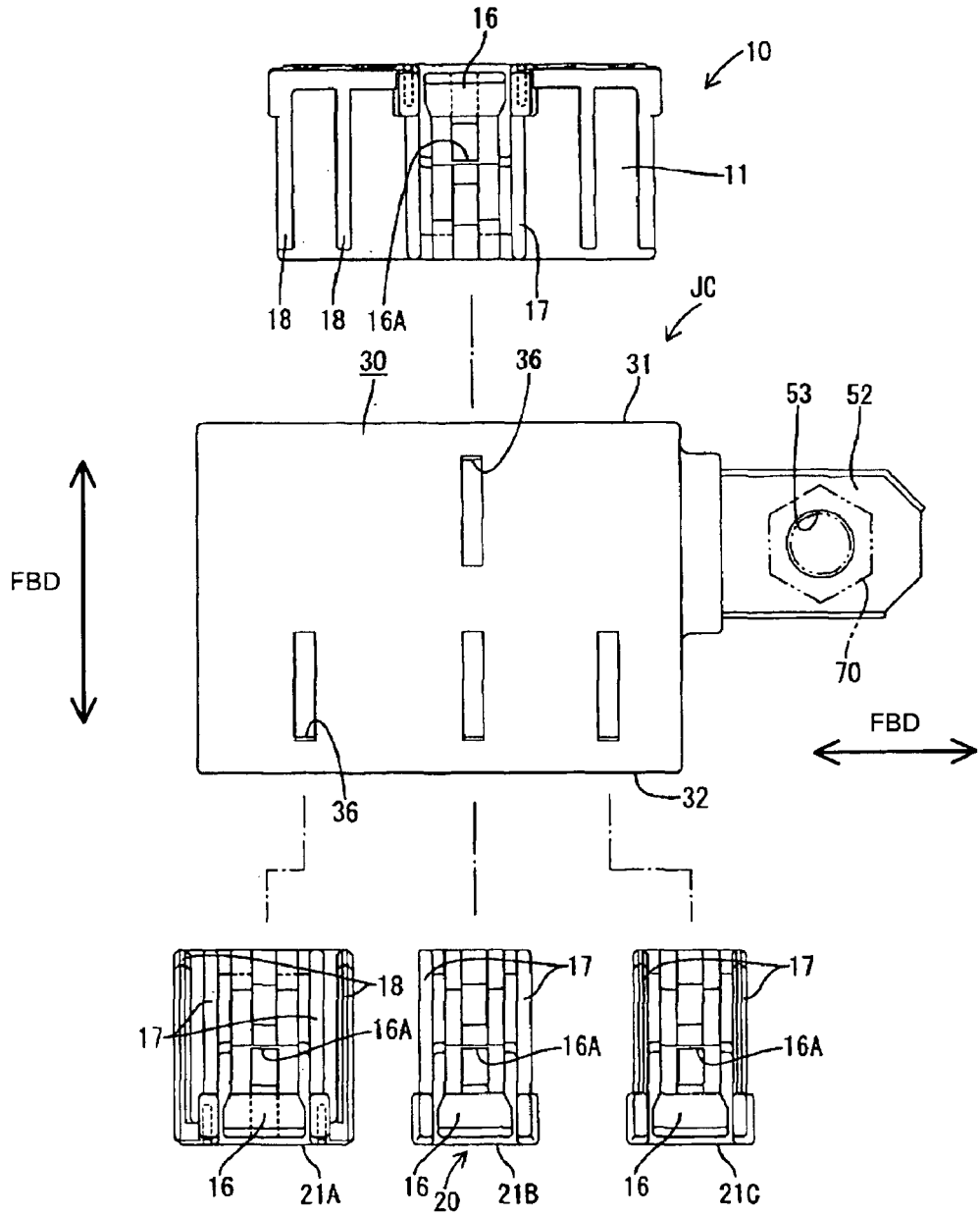
FIG. 1 is a plan view of a joint connector according to one embodiment of the invention and mating connectors.

A joint connector according to the invention is identified by JC in FIG. 1. A power-supply side connector 10 and an electronic- or electric-part or load side connector 20 as mating connectors are to be connected with substantially opposite surfaces of the joint connector JC.

Figure 3:
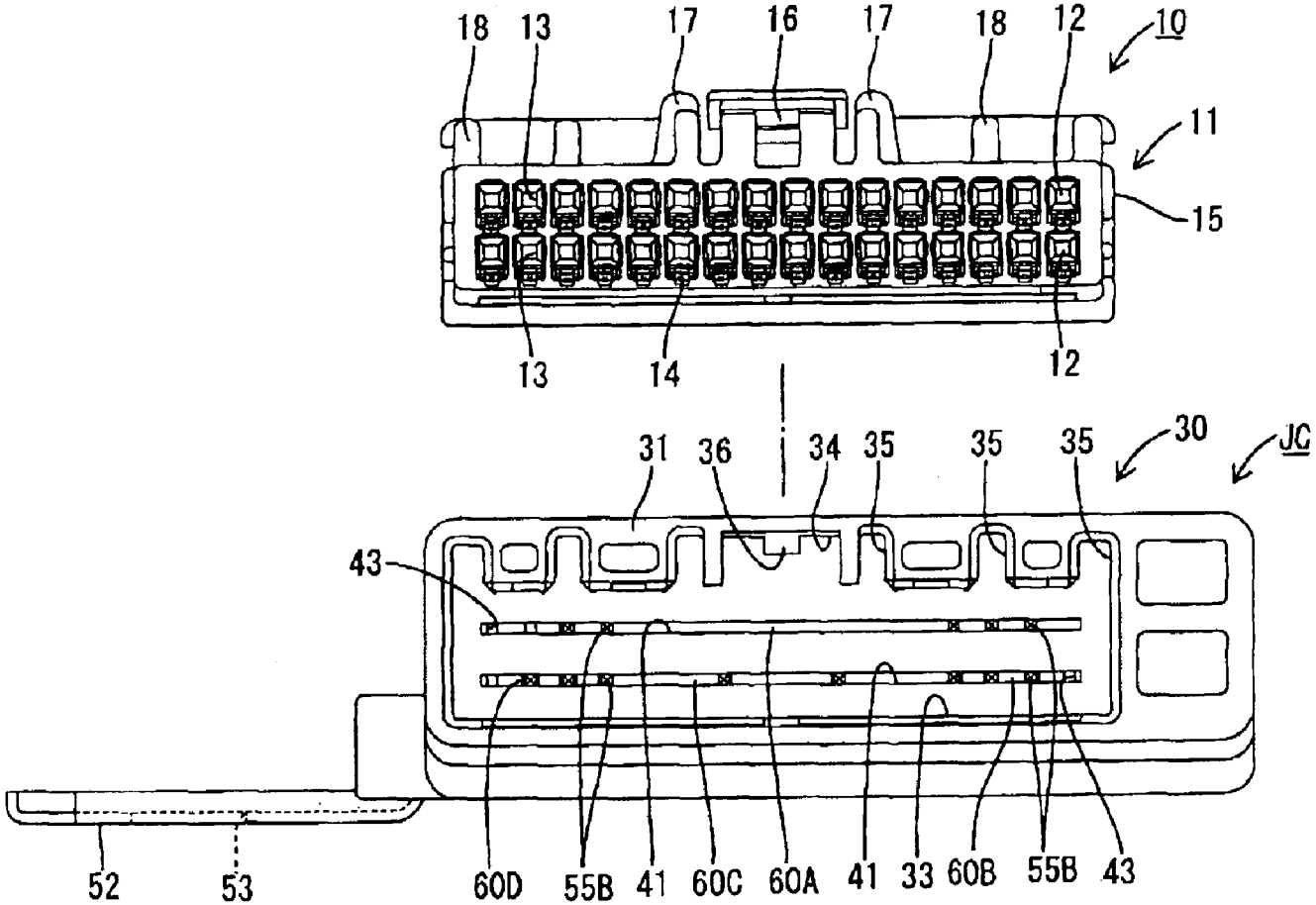
FIG. 3 is a rear view of the joint connector and a front view of a power-supply side connector.
Figure 4:
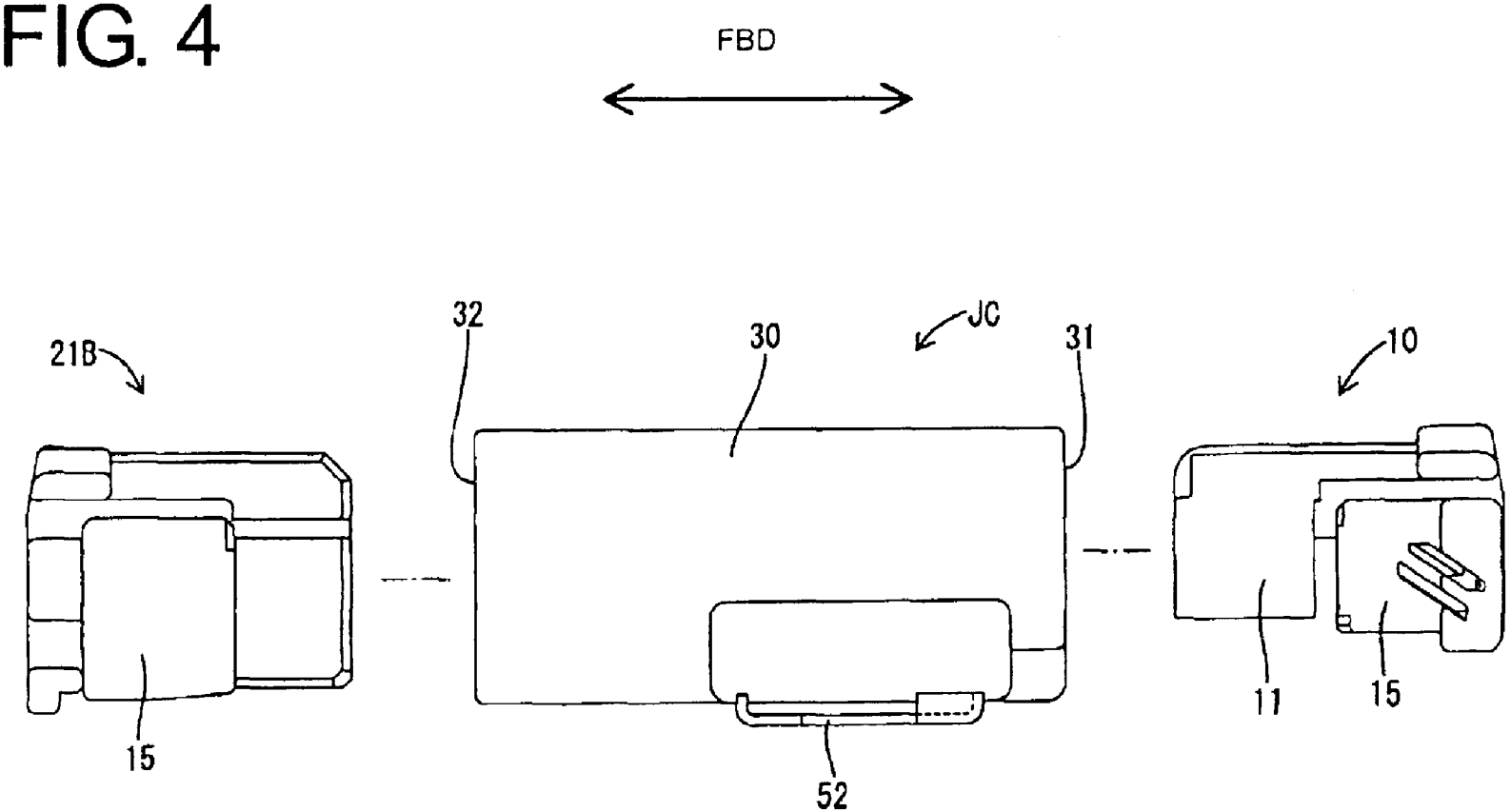
FIG. 4 is a side view of the joint connector and mating connectors.
Figure 5:
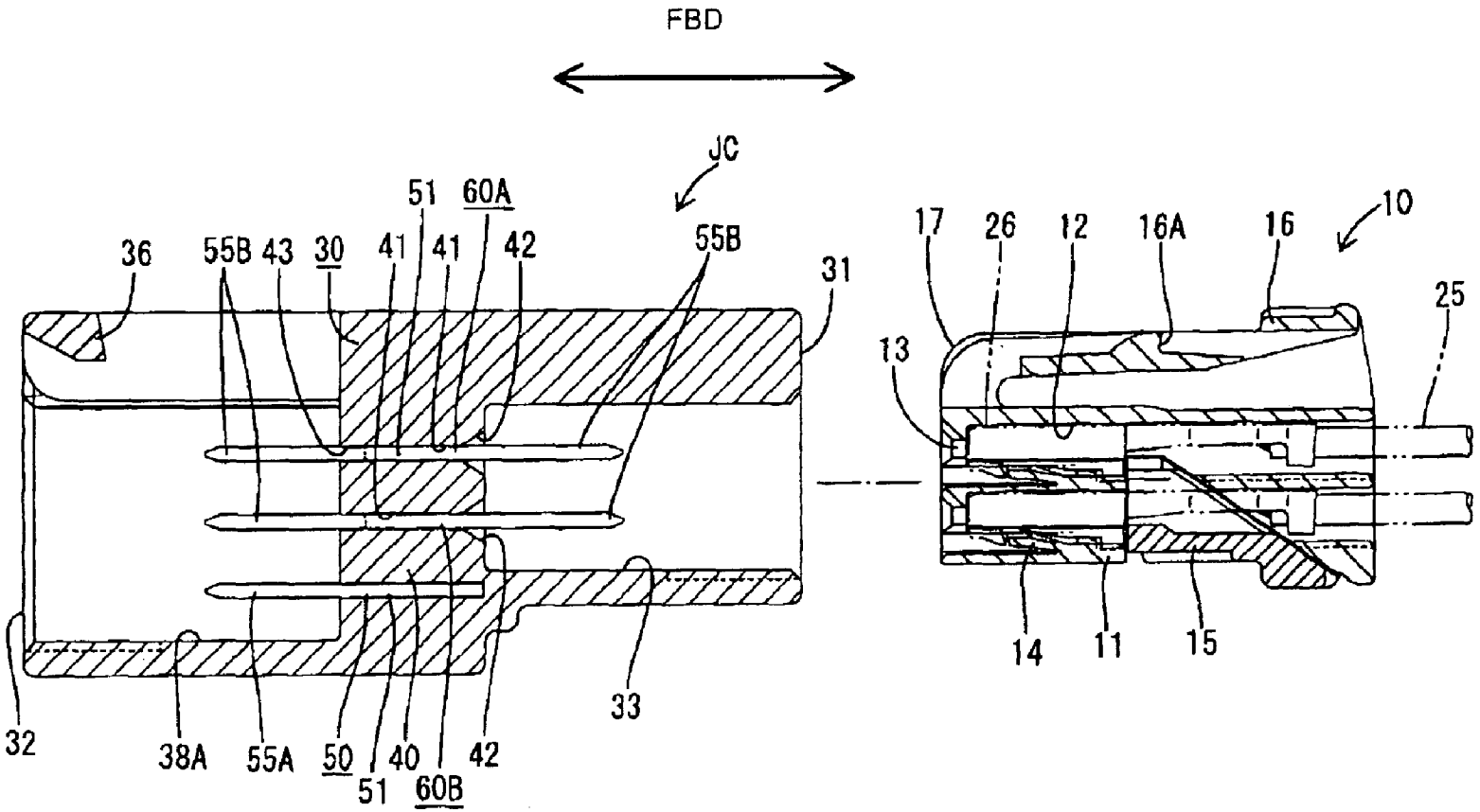
FIG. 5 is a section along 5—5 of FIG. 2 showing a state before the mating connector is connected.

The power-supply side connector 10 is provided with at least one female power-supply side housing 11 made e.g. of a synthetic resin. The power-supply side housing 11 is substantially in the form of a block having a wide cross section, as shown in FIGS. 3 and 5. Sixteen cavities 12 extend in forward and backward directions FBD at each of two levels, in the power-supply side housing 11. A terminal insertion opening 13 is formed in the front surface of each cavity 12.

Female terminals 26 are secured to ends of wires 25 and are inserted into the respective cavities 12 from behind (from right side in FIG. 5). The female terminals 26 are locked partly by locks 14 at the bottom surfaces of the cavities 12 and then are locked doubly by a retainer 15. Some of the cavities 12 are empty cavities into which no female terminal 26 is to be inserted.

A lock arm 16 is provided between left and right protection walls 17 substantially in the widthwise center of the upper surface of the power-supply side housing 11, and ribs 18 stand at suitable positions on the upper surface for preventing an upside-down or improper insertion.

The electric-part side connector 20 is comprised of first, second and third auxiliary housings 21A, 21B, 21C made e.g. of a synthetic resin.

Figure 2:
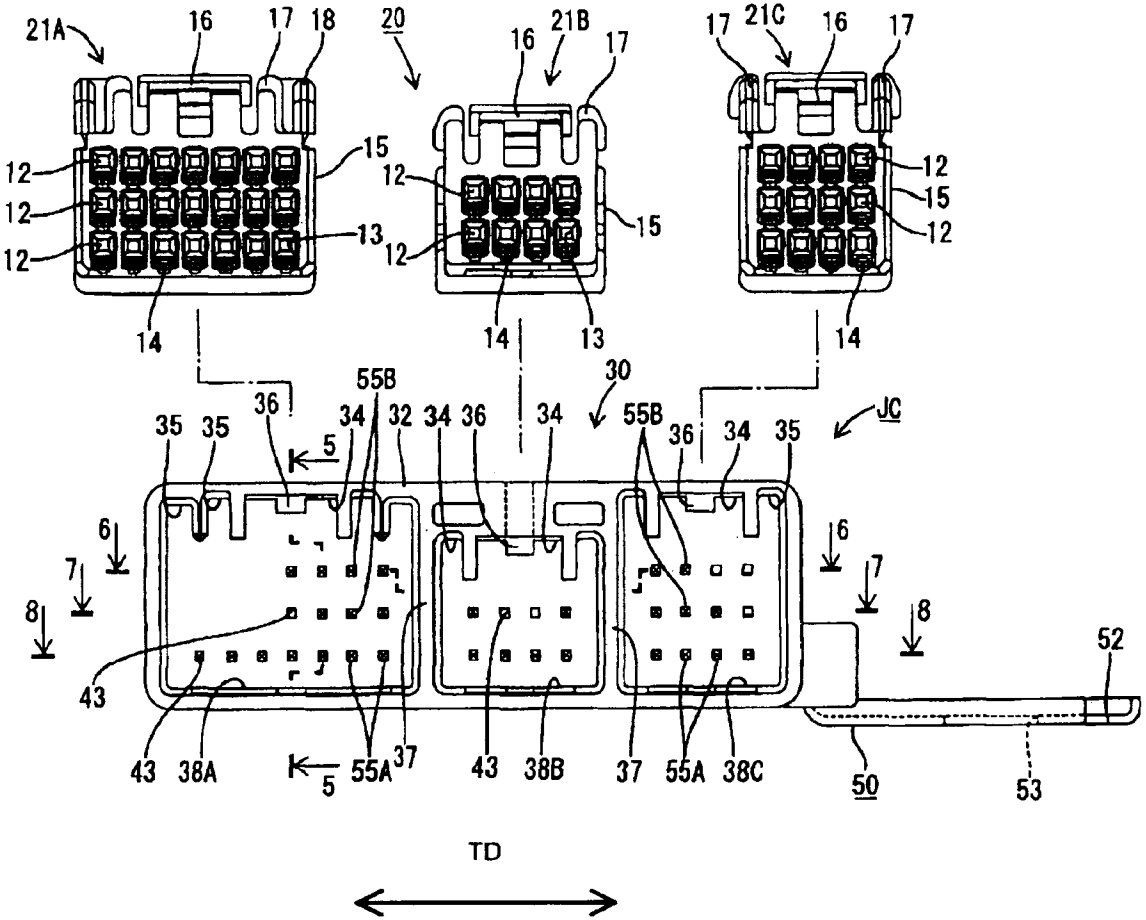
FIG. 2 is a plan view of the joint connector and a part side connector.

The first auxiliary housing 21A is a block and is the largest of the three auxiliary housings, as shown in FIG. 2. Seven cavities 12 are formed at each of three levels therein. A terminal insertion opening 13 is formed in the front surface of each cavity 12. Although not shown in detail, female terminals 26 secured to ends of wires 25 are inserted into the respective cavities 12 and are locked doubly by locks 14 and a retainer 15. A lock arm 16 is located between protection walls 17 and ribs 18 for preventing an upside-down or improper insertion are provided on the upper surface of the first auxiliary housing 21A.

The second auxiliary housing 21B has a smaller outer width and a shorter outer height than the first auxiliary housing 21A. Four cavities 12 are formed at each of two levels in the second auxiliary housing 21B for accommodating the doubly locked female terminals 26, and a lock arm 16 is located between protection walls 17 on the upper surface of the second auxiliary housing 21B.

The third auxiliary housing 21C has substantially the same height as the second auxiliary housing 21B, but a shorter width. Four cavities 12 are formed at each of three levels in the third auxiliary housing 21C for accommodating the doubly locked female terminals 26, and a lock arm 16 is located between protection walls 17 on the upper surface of the third auxiliary housing 21C.

The joint connector JC has a housing 30 e.g. made of a synthetic resin. The housing 30 is substantially in the form of a flat block, and connecting surfaces 31, 32 for the power-supply side connector 10 and the electric-part side connector 20 are set on opposite surfaces of the housing 30.

The connecting surface 31 has a power-supply side fitting recess 33 for receiving the power-supply side housing 11 of the power-supply side connector 10, as shown in FIG. 3. A groove 34 is formed in the upper surface of the power-supply side fitting recess 33 for receiving the lock arm 16 of the power-supply side housing 11, and a locking projection 36 is formed in the groove 34 for engaging a locking hole 16A in the lock arm 16, as shown FIG. 5. Grooves 35 also are formed in the upper surface of the power-supply side fitting recess 33 for receiving the protection walls 17 and the ribs 18 of the power-supply side housing 11.

Three electric-part side fitting recesses 38A, 38B, 38C are formed substantially side by side along a transverse direction TD in the connecting surface 32 of the electric-part side connector 20 and are partitioned by partition walls 37, as shown in FIG. 2. The first to third auxiliary housings 21A to 21C of the electric-part side connector 20 are individually fittable into the respective fitting recesses 38A, 38B, 38C. A groove 34 is formed in the upper surface of each fitting recesses 38A to 38C for receiving the lock arm 16 of the first to third auxiliary housings 21A to 21C, and a lock projection 36 is formed in each groove 34 for engaging a locking hole 16A in the lock arm 16. Grooves 35 also are formed in the upper surface of each of the fitting recesses 38A to 38C for receiving the protection walls 17 and the ribs 18 of each auxiliary housings 21A to 21C A thick partitioning wall 40 is formed between the back surfaces of the fitting recess 33 and those of the fitting recesses 38A to 38C.

The ground terminal 50 and the joint terminals 60 are mounted separately at three levels in the housing 30.

Figure 8:
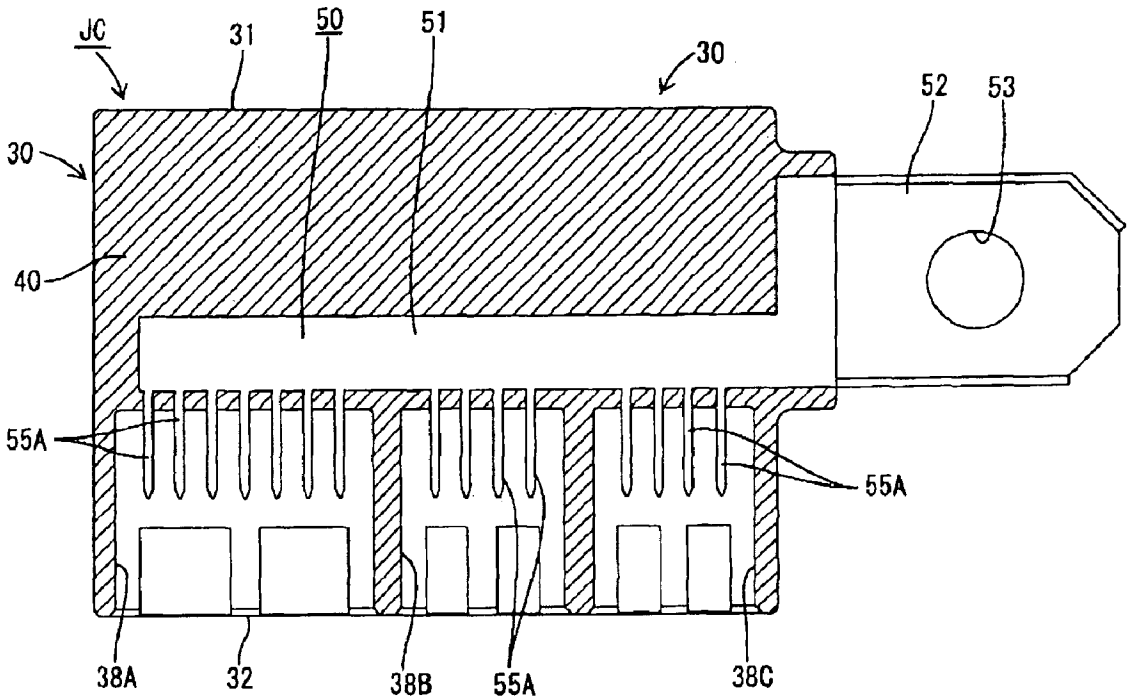
FIG. 8 is a section along 8—8 of FIG. 2.

The ground terminal 50 is mounted at the lower level. As shown in FIG. 8, this ground terminal 50 has a busbar 51 with a length substantially equal to the width of the housing 30. A wider grounding plate 52 is formed unitarily at one shorter lateral side of the busbar 51. The grounding plate 52 is lowered slightly to a different plane and is formed with a mount hole 53.

Fifteen tabs 55A project substantially side by side from the lower edge of the busbar 51 in FIG. 8. The tabs 55A are formed at the same intervals as the cavities 12 in the auxiliary housings 21A to 21C, and a corresponding number, e.g. seven tabs 55A, e.g. four tabs 55A and e.g. four tabs 55A project into the fitting recesses 38A, 38B, 38C, respectively.

The ground terminal 50 is mounted in the housing 30 by insert molding. Specifically, the busbar 51 is embedded in the intermediate wall 40 and the grounding plate 52 projects out below a bottom end position of one side surface of the housing 30 near the connecting surface 31 with the power-supply side connector 10. Further, the tabs 55A project into the fitting recesses 38A, 38B, 38C at bottom positions of the respective back surfaces of the fitting recesses 38A, 38B, 38C.

The joint terminals 60 are mounted at the other upper and middle levels. Hereinafter, reference numeral "60" is used when the joint terminals are referred to collectively, whereas suffixes "A to D" are attached to reference numeral "60" when they are described individually.

Figure 6:
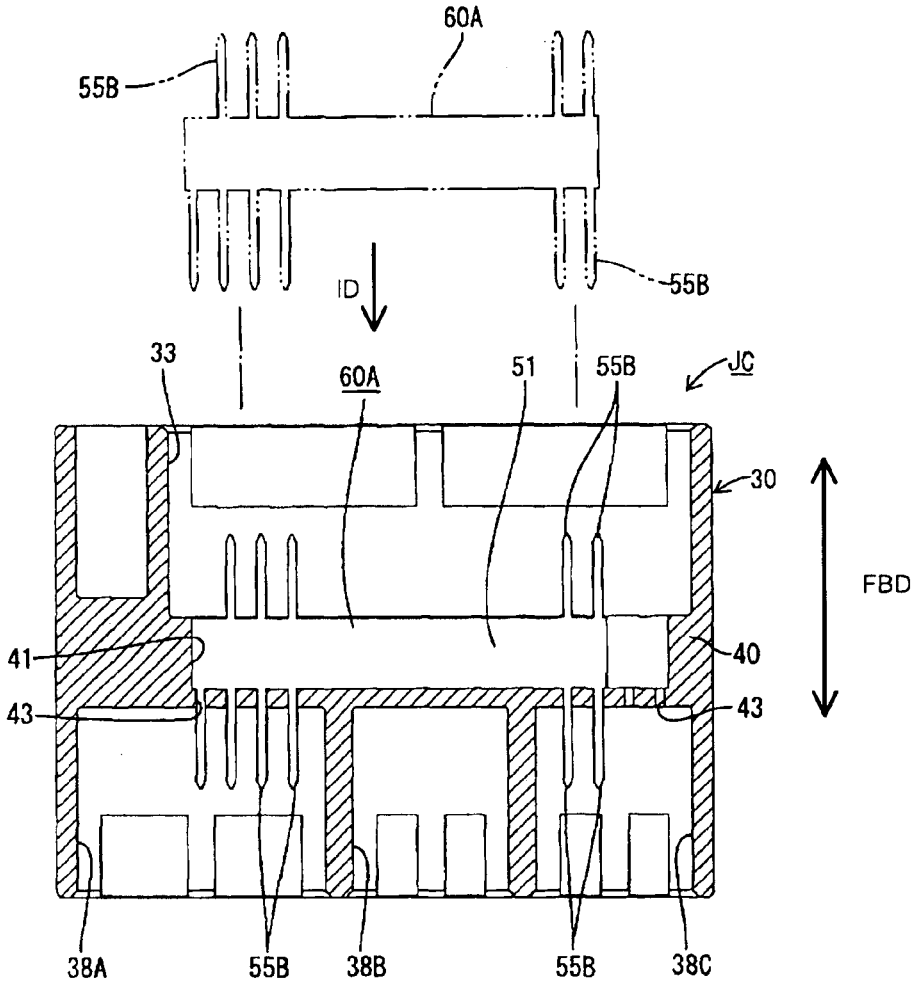
FIG. 6 is a section along 6—6 of FIG. 2.
Figure 7:
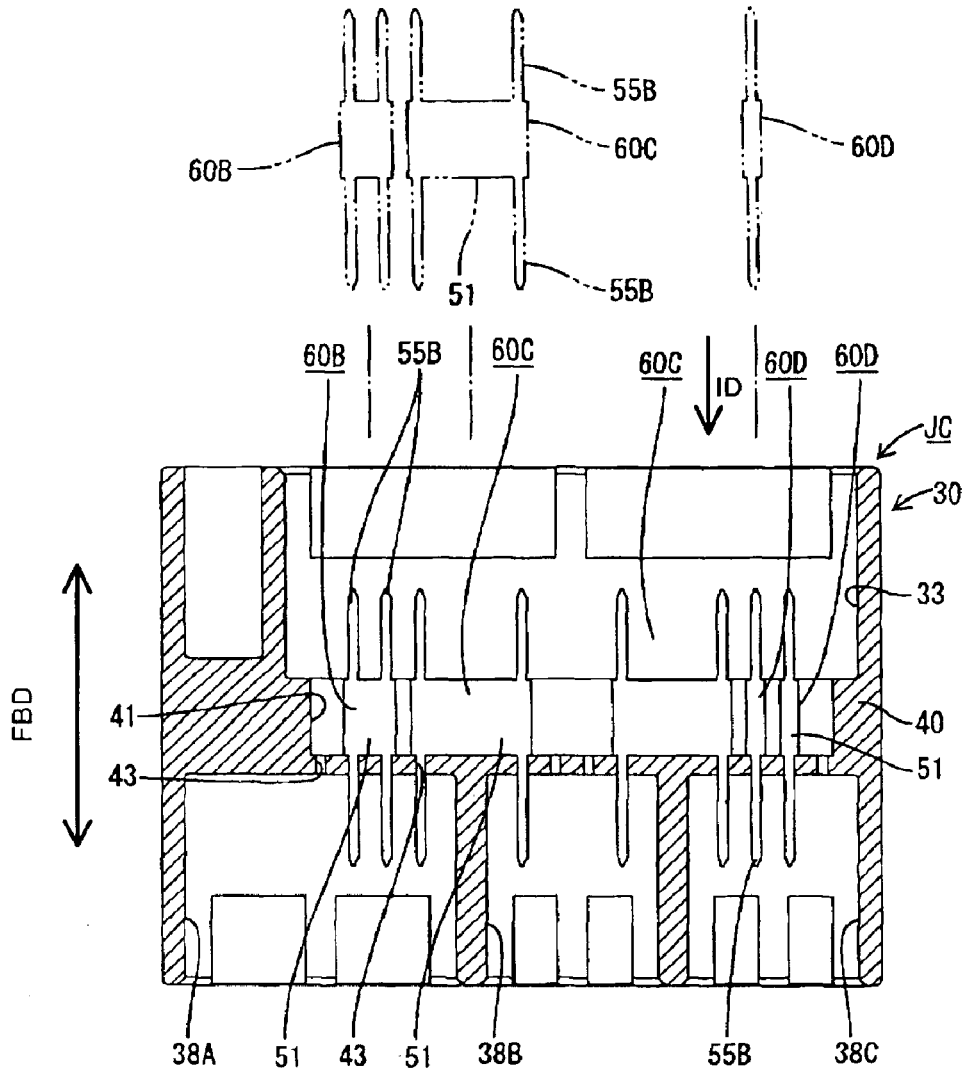
FIG. 7 is a section along 7—7 of FIG. 2.

The joint terminal 60 is formed so that tabs 55B project in a specified arrangement from each of the opposite lateral edges of a busbar 51. A plurality of joint terminals 60 having busbars 51 of different lengths are formed. For example, the joint terminal 60A at the upper level is a unitary piece with a long narrow busbar 51, as shown in FIG. 6. On the other hand, five joint terminals 60B, 60C, 60D with busbars 51 of different shorter lengths are mounted at the middle level, as shown in FIG. 7.

The joint terminals 60 are mounted in the housing 30 by pressing. Thus, insertion grooves 41 are formed at upper and middle positions in the surface of the intermediate wall 40 corresponding to the back surface of the power-supply side fitting recess 33, as shown in FIGS. 3 and 5, for closely receiving the joint terminals 60. Each insertion groove 41 stretches over substantially the entire width of the power-supply side fitting recess 33 and has a depth with a closed back end so that the busbar 51 can be exactly accommodated therein. A guide 42 is formed at the entrance of each insertion groove 41 and widens towards the front end.

Press-in holes 43 are formed at the closed ends of the insertion grooves 41 and the tabs 55B of the joint terminals 60 can be pressed into the press-in holes 43. The press-in holes 43 are formed at all the positions that can possibly receive the tabs 55B.

The ground terminal 50 is insert molded into the housing 30. A row of the tabs 55A of the ground terminal 50 project into the three fitting recesses 38A, 38B, 38C in the electric-part side connecting surface 32 at the bottom positions of the back surfaces of the respective fitting recesses 38A, 38B, 38C as shown in FIGS. 5 and 8. The grounding plate 52 projects out from the one side surface of the housing 30.

On the other hand, the joint terminals 60 are mounted into the previously formed housing 30. A plurality of kinds of joint terminals 60 are prepared in advance and have the busbars 51 of different lengths and/or different arrangements of the tabs 55B projecting from opposite edges of the busbars 51 so as to correspond to joint patterns.

The unitary joint terminal 60A for the upper level is inserted into the upper insertion groove 41 at the upper level in the back surface of the power-supply side fitting recess 33 as shown in FIG. 6. At an intermediate stage of the insertion, the tabs 55B facing forward with respect to inserting direction ID are pressed into the press-in holes 43, and the joint terminal 60A stops being pushed when the busbar 51 contacts the closed end of the insertion groove 41. Thus, the tabs 55B of the joint terminals 60A project in specified arrangements at the upper positions of the back surfaces of the power-supply side fitting recess 33 and of the three fitting recesses 38A, 38B, 38C formed in the electric-part side connecting surface 32 as shown in FIGS. 5 and 6.

The respective shorter joint terminals 60B to 60D for the middle level are inserted individually into the insertion groove 41 at the middle level from the power-supply side fitting recesses 33, as shown in FIG. 7. Similarly, the tabs 55B facing forward with respect to inserting direction ID are pressed into the press-in holes 43, and the joint terminals 60B to 60D stop being pushed when the busbars 51 contact the closed end of the insertion groove 41. Thus, the tabs 55B of the respective joint terminals 60B to 60D project in specified arrangements at the middle positions of the back surfaces of the power-supply side fitting recess 33 and of the three fitting recess 38A, 38B, 38C formed in the electric-part side connecting surface 32, as shown in FIGS. 5 and 7.

The lower level forms a ground joint connector and the upper and middle levels form an intermediate connector when the joint connector JC is assembled completely.

The mating connectors are connected with the joint connector JC. For example, the power-supply side connector 10 is fit into the power-supply side fitting recess 33 and locked by engaging the lock projection 36 with the locking hole 16A in the lock arm 16. The female terminals 26 in the power-supply side connector 10 are connected with the corresponding tabs 55B of the joint terminal 60 projecting from the back surface of the power-supply side fitting recess 33.

The first to third auxiliary housings 21A to 21C of the electric-part side connector 20 are fit successively into the three fitting recesses 38A, 38B, 38C in the electric-part side connecting surface 32 and are locked. Simultaneously, the female terminals 26 in the respective auxiliary housings 21A to 21C are connected with the corresponding tabs 55A of the ground terminal 50 or the corresponding tabs 55B of the joint terminals 60 projecting from the back surfaces of the fitting recesses 38A, 38B, 38C.

Finally, the grounding plate 52 of the ground terminal 50 is fixed to a body or a like member for grounding of a vehicle by a bolt 70 (see FIG. 1).

When the mating connectors are connected in this way, the female terminal fittings 26 at the lower levels of the respective auxiliary housings 21A to 21C of the electric-part side connector 20 and the wires 25 connected therewith are grounded via the ground terminal 50. Further, the wires 25 introduced into the power-supply side connector 10 and the wires 25 introduced at the two upper levels of the respective auxiliary housings 21A to 21B of the electric-part side connector 20 are jointed in specified patterns via the joint terminals 60 at the respective levels.

Upon a change in the joint pattern, a joint terminal corresponding to a new joint pattern is prepared separately and the new joint terminal is inserted into the insertion groove 41 in the housing 30.

As described above, one joint connector JC functions both as the ground joint connector and as the intermediate connector. Thus, operability is improved by reducing the number of the connecting operations with the mating connectors. Further, an installation space including a space for the connecting operations can be reduced, realizing a space-saving joint connector.

The ground terminal 50 and the joint terminals 60 are formed using the busbars 51 as bases, and therefore are thinner. Accordingly, the housing 30 having these terminals mounted at different levels therein is compact.

The joint pattern in the intermediate connector may change when a vehicle type differs. In such a case, different kinds of joint terminals 60 having different arrangements of the tabs 55B need to be prepared. If the joint terminals are mounted in the housing by insert molding, a molding die needs to be changed as the joint terminals are changed. However, the joint terminal 60 is mounted by pressing or fitting in this embodiment. Thus, the joint terminal 60 can be mounted into the housing 30 without taking any special measure even if the shape of the joint terminal 60 is changed. Therefore, a change in the joint pattern can be dealt with relatively inexpensively.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the part functioning as the ground joint connector and the part functioning as the intermediate connector are separated by the levels in the foregoing embodiment, the connector housing may be divided into a plurality of blocks along lengthwise and/or widthwise direction and each block may be apportioned for the part functioning as the ground joint connector or for the part functioning as the intermediate connector.

The ground terminal may also be mounted by pressing or fitting.

Procedures of connecting the joint connector with the mating connectors and mounting the grounding plate are not restricted to those illustrated in the foregoing embodiment. These procedures can be set arbitrarily.

What is claimed is:

1. A joint connector, comprising a housing with at least one pair of connecting portions into which mating connectors are fittable, at least one joint terminal having a plurality of terminal pieces located in both connecting portions and at least one ground terminal having a grounding portion projecting from the housing at a location spaced from the connecting portions, the ground terminal further having a plurality of terminal pieces in at least one of the connecting portions.

2. The joint connector of claim 1, wherein the joint terminal is formed such that the terminal pieces project from two different lateral edges of a busbar.

3. The joint connector of claim 1, wherein the ground terminal is formed such that the terminal pieces project from at least one lateral edge of a busbar having the grounding portion at an end thereof.

4. The joint connector of claim 1, wherein the joint terminal and the ground terminal are mounted at different levels in the housing.

5. The joint connector of claim 1, wherein the joint terminal is mounted into the housing by pressing.

6. The joint connector of claim 5, wherein the housing comprises insertion grooves into which at least part of the joint terminal is closely insertable.

7. The joint connector of claim 6, wherein press-in holes are provided in the housing for pressing in corresponding terminal pieces of the joint terminal.

8. A joint connector, comprising:

a housing molded from a resin material and having opposite power and load sides, an intermediate wall between the power and load sides, a power receptacle extending into the power side and to the intermediate wall, at least one load receptacle extending into the load side and to the intermediate wall, a plurality of press-in holes formed in the intermediate wall for providing communication between the power and load receptacles;

a grounding terminal, a grounding portion projecting from an end of the busbar and a plurality of terminal pieces projecting from one side of the busbar, the grounding terminal being insert molded into the housing so that the busbar is substantially surrounded by a unitary matrix of resin in the intermediate wall and so that the terminal pieces project into the at least one load receptacle and so that the grounding portion projects from the housing at a location spaced from the power and load receptacles; and at least one joint terminal having a busbar and plurality of terminal pieces projecting from both opposite sides of the busbar, the terminal pieces on one side of the busbar being pressed through selected ones of the press-in holes and into the load side receptacle.

9. The joint connector of claim 8, wherein the intermediate wall of the housing comprises insertion grooves facing into the load side receptacle, the busbar of the joint terminal being closely received in the insertion groove.

10. The joint connector of claim 9, wherein at least one press-in hole has no terminal piece therein.

11. The joint connector of claim 9, wherein the joint terminal and the ground terminal are mounted at different levels in the housing.

12. A method of manufacturing a joint connector, comprising:

providing a grounding terminal having a busbar, a plurality of terminal pieces projecting from one side of the busbar and a grounding portion at an end of the busbar;

molding a housing from a resin material so that the housing has oppositely facing connecting receptacles separated by an intermediate wall and so that the busbar of the grounding terminal is insert molded in the intermediate wall with the terminal pieces projecting into one of the connecting receptacles and so that the grounding portion projects from the housing at a location spaced from the connecting receptacles;

providing at least one joint terminal having a busbar and plurality of terminal pieces projecting from both opposite sides of the busbar; and pressing the joint terminal through the intermediate wall so that the terminal pieces project into both connecting receptacles.

13. The method of claim 12, wherein the step of molding the housing comprises forming press-in holes in the intermediate wall at all possible positions for the terminal pieces of the joint terminal.

14. The method of claim 13, wherein the step of providing at least one joint terminal comprises providing a plurality of different joint terminals, the method further comprising selecting specified joint terminals, and mounting the selected joint terminals in the housing so that the terminal pieces are press fit through only selected ones of the press-fit holes.

* * * * *